United States Patent [19]

Lewis

[11] 4,415,435

[45] Nov. 15, 1983

[54] CATALYTIC REFORMING PROCESS

[75] Inventor: William E. Lewis, Baton Rouge, La.

[73] Assignee: Exxon Research and Engineering Co., Florham Park, N.J.

[21] Appl. No.: 422,675

[22] Filed: Sep. 24, 1982

[51] Int. Cl.[3] ..... C10G 35/06

[52] U.S. Cl. ..... 208/65

[58] Field of Search ..... 208/65

[56] References Cited

U.S. PATENT DOCUMENTS

| | | | |
|---|---|---|---|
| 4,166,024 | 8/1979 | Swan | 208/65 |
| 4,348,271 | 9/1982 | Swan | 208/65 |
| 4,354,925 | 10/1982 | Schorfheide | 208/65 |

*Primary Examiner*—Curtis R. Davis

*Attorney, Agent, or Firm*—Llewellyn A. Proctor

[57] ABSTRACT

A process for the optomization of the amount of sulfur introduced into a cyclic, or semi-cyclic reforming unit consistant with the dual objective of sulfiding a sulfur-sensitive polymetallic platinum catalyst, and minimizing the average sulfur present in the unit during an operating cycle. In accordance with such process, a sulfur-containing naphtha feed between reactor swings is first hydrofined to reduce the sulfur content of the feed, the product therefrom is then passed through a guard bed or reactor and contacted with a sulfur adsorbent essentially completely remove the feed sulfur to maximize catalyst activity, catalyst stability and $C_5+$ liquid yield. At the time of, or just prior to, swinging on-stream a reactor which contains an unsulfided fresh, or unsulfided regenerated, reactivated sulfur-sensitive polymetallic platinum catalyst, the series of reactors is by-passed around the hydrofiner and guard chamber and the product from the hydrofiner fed directly into the series of reactors to sulfide the catalyst.

3 Claims, 1 Drawing Figure

FIGURE
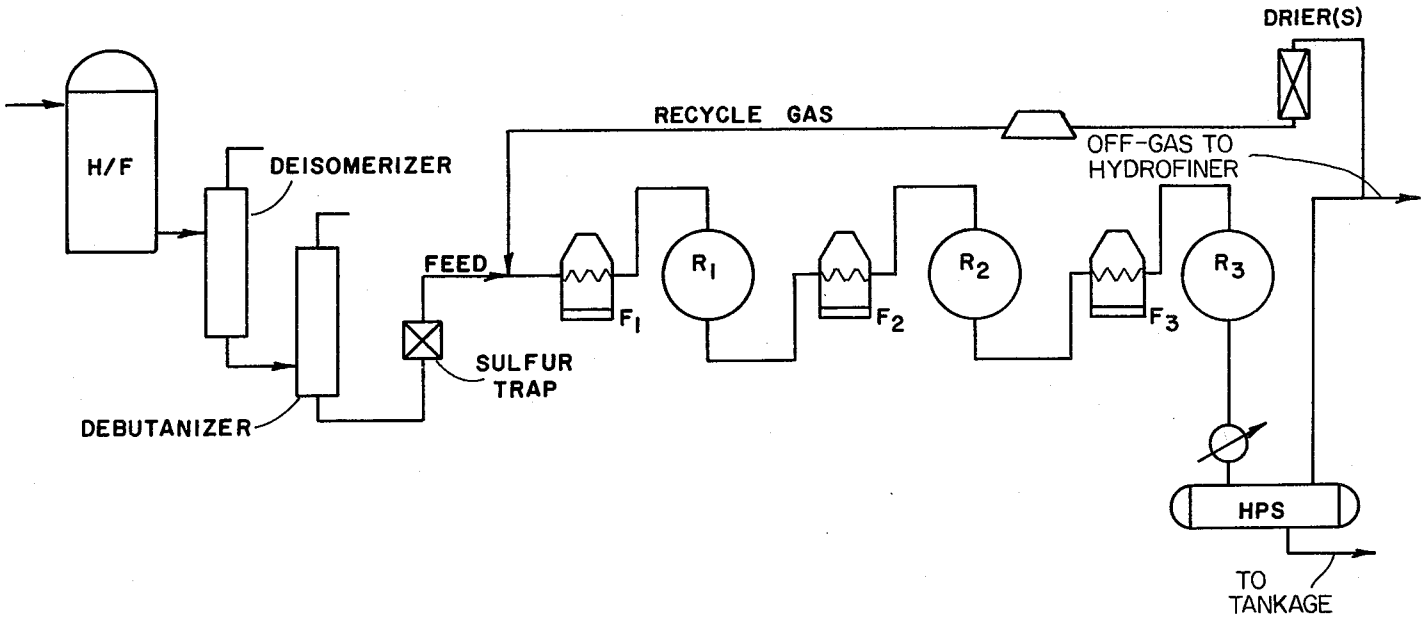

CATALYTIC REFORMING PROCESS

BACKGROUND OF THE INVENTION AND PRIOR ART

Catalytic reforming, or hydroforming, is a well established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization on n-paraffins; isomerization of alkylcycloparaffins to yield cyclohexanes; isomerization of substituted aromatics; and hydrocracking of paraffins which produces gas, and inevitably coke, the latter being deposited on the catalyst.

Platinum has been widely commercially used in recent years in the production of reforming catalysts, and platinum-on-alumina catalysts have been commercially employed in refineries for the last few decades. In the last decade, polymetallic catalysts have been commercialized by the addition of other metallic components to platinum as promoters to further improve the activity or selectivity, or both, of the basic platinum catalyst, e.g., iridium, rhenium, tin, and the like. Platinum-rhenium catalysts, by way of example, possess admirable selectivity as contrasted with platinum catalysts, selectivity being defined as the ability of the catalyst to produce high yields of $C_5+$ liquid products with concurrent low production of normally gaseous hydrocarbons, i.e., methane and other gaseous hydrocarbons, and coke.

Reforming reactions are both endothermic and exothermic, the former predominating, particularly in the early stages of reforming with the latter predominating in the latter stages of reforming. In view thereof, it has become the practice to employ a plurality of adiabatic fixed-bed reactors in series with provision for interstage heating of the feed to each of the several reactors. There are two major types of reforming. In semi-regenerative reforming, the entire unit is operated by gradually and progressively increasing the temperature to compensate for deactvation of the catalyst caused by the coke deposition, until finally the entire unit is shut down for regeneration, and reactivation, of the catalyst. In cyclic reforming, the reactors are individually isolated, or in effect swung out of line by various arrangements, the catalyst is regenerated within the regenerator circuit to remove the coke deposits, and then reactivated while the other reactors of the series remain on-stream. A "swing reactor" temporarily replaces a reactor which is removed from the series of in circuit reactors for regeneration and reactivation of the catalyst, and is then put back in series. Such an operation is described by reference to U.S. Pat. No. 4,166,024 which issued Aug. 28, 1979, to George A. Swan, particular reference being made to the figure and the description thereof at Column 5, beginning at line 61 and continuing through Column 7 at line 21; which disclosure is herewith incorporated as part and parcel of the present application. In either type of reforming, hydrogen is produced in net yield, the product being separated into a $C_5+$ liquid product, e.g., a $C_5+$/430° F. product, and a hydrogen rich gas a portion of which is recycled, generally after passage through a recycle gas drier to the several reactors of the process unit. In semi-cyclic reforming the reforming unit contains both reactors which remain in operation throughout the length of the operating cycle, i.e., from start-up to shutdown for regeneration, and reactivation of the catalyst, and reactors which are replaced for regeneration and reactivation of the catalyst by swing reactors throughout the length of the operating cycle.

Essentially all petroleum naphtha feeds contain sulfur, a well known catalyst poison which can gradually accumulate upon and poison the catalyst. Most of the sulfur, because of this adverse effect, is generally removed from feed naphthas, particularly by hydrofining, or hydrogen treating. In use of the more recently developed polymetallic platinum catalysts wherein an additional metal, or metals, hydrogenation-dehydrogenation component is added as a promoter to the platinum, it has become essential to reduce the feed sulfur to only a few parts, per million parts by volume of feed (ppm). For example, in the use of platinum-rhenium catalysts it is essential to reduce the sulfur concentration of the feed well below about 10 ppm, and preferably well below about 2 ppm, to avoid excessive loss of catalyst activity, and $C_5+$ liquid yield. It is thus known, e.g., that as little as 2 ppm of feed sulfur over the length of the operating cycle can lower catalyst activity by as much as 15%, and $C_5+$ liquid yield by as much as 1 LV %. For this reason, generally, the product from the hydrofiner is stripped, and then fed to a guard chamber, e.g., one which contains nickel oxide, cobalt oxide, zinc oxide or the like, to essentially completely remove any residual sulfur from the feed.

The role of sulfur on the catalyst presents somewhat of an anomaly because the presence of sulfur in the feed can adversely affect the activity of the catalyst and reduce liquid yield; and yet, sulfiding of the polymetallic catalyst species, which is a part of the catalyst reactivation procedure, has been found essential to suppress excessive hydrogenolysis which is particularly manifest, when a reactor is first put on-stream after regeneration and reactivation of the catalyst. Excessive hydrogenolysis caused by use of these highly active catalysts can not only produce acute losses in $C_5+$ liquid yield through increased gas production, but the severe exotherms which accompany operation in a hydrogenolysis mode can seriously damage the catalyst, reactor, and auxiliary equipment. In semi-regenerative reforming, for example, it has been found that when the reactors of a unit which contain fresh, or regenerated, reactivated highly active rhenium promoted platinum catalysts are put back on-stream, the start-up period is characterized by an initial loss of catalyst activity and loss of $C_5+$ liquid yield. The same phenomenon is observed in cyclic reforming. When a platinum-rhenium catalyst loaded reactor is reinserted in the multiple reactor series of the unit, albeit it contains a fresh catalyst, or a regenerated, reactivated, sulfided catalyst, there occurs an initial upset period when the catalyst activity and $C_5+$ liquid yield of the unit is reduced. It has been observed that his effect is first noted in the reactor immediately downstream of the swing reactor which when first put on-stream contains a freshly sulfided catalyst. A quantity of sulfur is released when the freshly sulfided catalyst is contacted with the feed, the sulfur wave travelling downstream from one reactor to the next of the series. Concurrently with the sulfur wave there results a loss in C+ liquid yield which, like a wave, also progresses in seratim from one reactor of the series to the next until finally the $C_5$+ liquid yield loss is observed throughout the unit. Over a sufficiently long period after the initial decline in $C_5$+ liquid yield loss, the $C_5$+ liquid yield in the several reactors of the unit, and consequently the overall performance of the unit, gradually improves, though often the improvement is not sufficient to return each of the reactors of the unit, or unit as a whole, to its original higher performance level.

In the use of polymetallic catalysts it is essential to utilize good sulfur strategy, especially as contrasted with the use of the older, less sulfur-sensitive and conventional platinum catalysts. (1) One approach to the problem has been to maintain sulfur on the fresh, or regenerated, reactivated catalyst in the reactor as it is first swing on oil. In this approach, the catalyst is presulfided while in the regeneration circuit as by treatment to breakthrough with a sulfur-containing gas, e.g., hydrogen sulfide-in-hydrogen. The reactor, after the catalyst ispresulfided, is then swung on oil. (2) A second approach involves a consideration of the amount of sulfur in the feed and gas of the reactor circuit. In this approach the fresh, or regenerated, reactivated catalyst is not presulfided in the regenerator circuit but rather it is sulfided in situ within the reactor circuit by contact with relatively high hydrogen-sulfide containing gases. The high hydrogen sulfide in the reactor circuit, e.g., from about 0.6 to 10 ppm, sulfides the catalyst suppressing exotherms and rapid coking. (3) A third approach relates to maintaining an average, low sulfur level throughout the operating cycle. Pulses of sulfur are provided for the most part by sulfur releases from the regenerated, reactivated catalyst as the reactors containing the fresh, or regenerated, reactivated catalysts are swung on oil. These approaches have been moderately successful but further improvements are nonetheless needed.

It is, accordingly, the primary object of this invention to provide a new and improved process that will obviate these and other disadvantages of present catalyst sulfiding procedures for cyclic reforming units, particularly those employing highly active polymetallics, or promoted noble metal containing catalysts.

A specific object is to provide a novel operating procedure for cvyclic reforming units, notably one which will enhance catalyst activity and more effectively suppress $C_5$+ liquid yield decline which is particularly acute when sulfur is present during reforming operations with metal promoted platinum catalysts, particularly rhenium promoted platinum catalysts.

These objects and others are achieved in accordance with the present invention embodying an improved process wherein, in the operation of a cyclic reforming unit, a sulfur-containing naphtha feed is first hydrofined to reduce the sulfur content of the feed, the product therefrom is then passed through a guard bed or reactor and contacted with a sulfur adsorbent to essentially completely remove the feed sulfur, and thereby maximize catalyst activity, catalyst stability and $C_5$+liquid yield, the improvement wherein at the time of, or just prior to, swinging on-stream a reactor which contains an unsulfided fresh, or unsulfided regenerated, reactivated sulfur-sensitive polymetallic platinum catalyst, the series of reactors is by-passed around the hydrofiner and guard chamber and product from the hydrofiner fed directly into the series of reactors to sulfide the catalyst.

In accordance with this invention, the amount of sulfur introduced into the reforming unit is optomized consistant with the dual objective of sulfiding the catalyst, and minimizing the average sulfur present in the unit during an operating cycle. During normal operation, i.e., between reactor swings, the reformer feed is desulfurized in the hydrofiner and guard chamber to essentially completely remove the sulfur. Hence, between reactor swings the reformer feed contains from about zero to about 2 ppm sulfur, preferably from about 0.01 to about 0.5 ppm sulfur, which feed is passed at reforming conditions through the series of metal promoted, platinum-catalyst containing reactors. This maximizes catalyst activity, catalyst stability, and $C_5$+liquid yields. (It may also protect the unit in the event of a hydrofiner upset which may feed additional sulfur into the unit.) On the other hand, however, it is well known that exotherms occur when an unsulfided catalyst is swung on oil without sulfur in the feed or recycle gas. Accordingly, at the time a reactor containing the unsulfided catalyst is swung on oil, a sufficient amount of unhydrofined sulfur-containing feed is fed directly into the unit to sulfide the unsulfided catalyst of the reactor placed on oil. An amount of the un-hydrofined sulfur-containing feed sufficient to introduce from about 0.6 to about 10 ppm, preferably from about 0.6 to about 5 ppm, sulfur into the feed is adequate. Immediately after the unsulfided catalyst is sufficiently sulfided by the by passing unhydrofined feed, the flow of feed by passing the hydrofiner is interrupted and the unit is again operated at essentially zero sulfur conditions. This method of operation is particularly advantageous in the operation of cyclic (or semi-cyclic) units which do not contain driers. Sulfur is contained in the reforming unit only during catalyst swings, and its concentration in the unit is negligible at all other times. In effect, the average sulfur level over the length of the cycle is minimized. The advantages of this over presulfiding catalyst in the regeneration circuit is that large bursts of sulfur do not occur to the same extent such as would cause heavy loads of hydrogen sulfide for removal by the driers. This process thus allows optimum sulfur control of the unit at all times. Hence, one maximizes yield and catalyst activity performance for each unit on an individual basis. The implications of these improvements are particularly important for units which operate without driers, and it is well known in the art that driers are not reliable for sulfur control. Hence, this process becomes particularly important as drier performance deteriorates. It is thus known that without driers a reactor swing is required about each 71 hours, whereas this process maintains the unit near zero sulfur except for about 0.1 to about 2 hours prior to and during reactor swings; and then only a small amount of sulfur need be purged from the unit after a swing.

These features and others will be better understood by reference to the following more detailed description of the invention, and to the drawing to which reference is made.

In the drawing:

The FIGURE depicts by means of a simplified flow diagram a preferred apparatus combination, inclusive of a hydrofiner, sulfur guard chamber, and a reforming unit inclusive of a series of on-stream reactors.

Referring to the FIGURE, generally, there is described an apparatus combination inclusive of a hydrofiner, H/F, a stripper, S, guard chamber, GC, and a reforming unit comprised of a multi-reactor system, inclusive of reactors $R_1$, $R_2$, and $R_3$, each packed with fixed beds of an appropriate polymetallic, promoted platinum catalyst. Each of the reactors $R_1$, $R_2$, and $R_3$ are connected in series and preceded by a heater or preheat furnace, $F_1$, $F_2$, and $F_3$, respectively. Pumps, compressors, and other auxiliary equipment are omitted for clarity. A sulfur-containing hydrocarbon feed, or naphtha, is fed into the hydrofiner, H/F, and the product therefrom then passed to stripper, S, for removal of the preponderance of the sulfur. The liquid product from stripper S is then passed through a guard chamber, GC, generally one which contains copper chromite, nickel oxide, cobalt oxide, or the like, to remove the balance of the sulfur and provide a desulfurized product containing no more than about 2 ppm sulfur, preferably from about 0.01 to about 0.5 ppm sulfur, this product being used as a feed to the reforming unit. This product, as feed, during normal operation is serially passed, with hydrogen, through $F_1R_2$, $F_2R_2$, and $F_2R_3$, with the products from the reactions being passed to a high pressure separator, HPS. Suitably, $R_1$, $R_2$, and $R_3$ are filled with the more sulfur sensitive polymetallic catalysts, suitably platinum-rhenium-alumina catalysts. A portion of the hydrogen-rich make gas can be taken from the top of the high pressure separator HPS and, after passage through a make gas compressor, sent to the hydrofiner, H/F, and another portion recycled through gas driers to the lead furnace and reactor $F_1R_1$. $C_5$+liquids from the bottom of high pressure separator HPS are sent to a stabilizer, or to tankage.

During normal operation, the feed is passed serially through hydrofiner H/F, stripper S, and the guard chamber GC to remove essentially all of the sulfur, or to maintain as near to a zero level of sulfur as feasible. On substitution or replacement of any of reactors $R_1$, $R_2$, and $R_3$ by another reactor, as by an off-stream reactor S (not shown) whose catalyst, though unsulfided, has been regenerated, and reactivated, the by-pass line is again closed and all of the product from the hydrofiner H/F and guard chamber GC again introduced into the reforming unit. Or, just prior to such substitution or replacement, the flow of product from the hydrofiner H/F to the stripper S, and guard chamber GC is reduced or interrupted, and the by pass line opened to introduce sufficient of the unhydrofined product to $F_1$, $R_1$ to provide a reformer feed containing from about 0.6 to about 10 ppm, preferably from about 0.6 to about 5 ppm, of sulfur to adequately sulfide the catalyst, the by-pass line is again closed and all of the product from the hydrofiner H/F and guard chmber GC again introduced into the reforming unit.

The invention, and its principle of operation, will be more fully understood by reference to the following example provided by simulations from actual operations, which characterizes a preferred mode of operation.

EXAMPLE

A 10,000 barrel/day cyclic reformer unit (four reactors, and an additional swing reactor configuration) is operated at 200 psig, a 3000 SCF/B recycle gas rate, and each reactor at a sufficient temperature to produce a 97 RONC product octane on a light arabian naphtha feed introduced into the lead reactor at a rate of 1.5 W/Hr/W. A GC distillation on the feed is given as follows, to wit.

GC DISTILLATION OF FEEDSTOCK
Light Arabian Naphtha

| Weight % | Temperature °F. |
|---|---|
| 1 | 140 |
| 5 | 152 |
| 10 | 166 |
| 50 | 249 |
| 90 | 332 |
| 99 | 388 |
| 99.9 | 438 |
| Other feedstock inspections are given as follows: | |
| Sulfur | 0.10 |
| Chloride | 0.27 |
| Gravity, API | 60.1 |
| Nitrogen | 0.10 |

Four reactors, $R_1$, $R_2$, $R_3$, and $R_4$, of the series were charged with a total of 71,761.7 pounds, and the swing reactor with 19,950 pounds, of a platinum-rhenium (0.3 wt. % Pt/0.3 wt. % Re) catalyst, containing 1.0 wt. % chloride, each reactor being charged as follows:

| Reactor | Reactor Catalyst Charge |
|---|---|
| $R_1$ = | 11,912 Pounds |
| $R_2$ = | 19,950 Pounds |
| $R_3$ = | 19,950 Pounds |
| $R_4$ = | 19,950 Pounds |
| Swing = | 19,950 Pounds |

A naphtha hydrofiner and guard chamber are located upstream of the reformer unit. The hydrofiner operates at 250 psig, 2 V/V/Hr, and a temperature of 500–700° F. to desulfurize the feed such that with the guard chamber loaded with copper chromite only about 0.05 ppm sulfur remains in the process feed which is introduced at a rate of 107,642.5 pounds/hour into the lead reactor after passage through the guard chamber.

When the catalyst in $R_1$ is deactivated, and replaced by swing reactor S, the catalyst of the swing reactor is sulfided to a level of 0.04% sulfur by by-passing the hydrofiner and guard chamber and passing for one hour the sulfur-containing hydrofiner feed which contains 4.76 pounds of sulfur in the 107,642.5 pounds of charge feed (i.e., 44 wppm) directly into the swing reactor. When sulfiding the catalyst of $R_2$, $R_3$, $R_4$ or the swing reactor, a 67% longer sulfiding time is required in use of the same feed.

Credits relative to sulfiding with $H_2S$ in regeneration position are generally as follows, to wit: (1) Only half amount of sulfur added to the reactor system compared to adding 0.08 wt. % onto the catalyst in the regeneration circuit and sulfiding to breakthrough. (2) Sulfur added by this procedure stays on the catalyst and does not affect downstream reactors. For $R_1$ yield credits up to 3 LV% at constant octane can be obtained during a sulfiding period of 15–60 minutes. For $R_2$ this diminishes to 2 LV% or less with only 1 % of less expected for $R_3$ and negligible credit for $R_4$. For units without effective driers (which also remove $H_2S$) credits become substantially larger. The reason is because this procedure adds only the sulfur which goes on the catalyst whereas the old procedure, i.e., sulfiding to breakthrough in the regeneration circuit adds twice as much sulfur as retained by the catalyst in the one oil position. Without effective driers this sulfur enters the recycle gas system and returns to the reactors unit it is purged from the unit completely as part of the make gas.

This invention is applicable to the operation of a cyclic reforming unit, or a semi-cyclic, or hybrid reforming unit which features in part a cyclic type of operation. Reforming catalysts suitable for the practice of this invention are constituted of a Group VIII noble metal, or platinum group metal hydrogenation-dehydrogenation component, especially platinum promoted with one or more additional platinum group or non-platinum group metallic components such as germanium, gallium, tin, iridium, tungsten, and the like; especially rhenium. A preferred type of catalyst contains the hydrogenation-dehydrogenation component in absolute concentration ranging from about 0.01 to about 3 wt. %, and preferably from about 0.5 to about 1.0 wt. %, based on the total catalyst composition. The metal promoter component is also added in absolute concentrations ranging from about 0.01 to about 3 wt. %, preferably from about 0.5 to about 1.0wt. %. In addition, such catalysts also usually contain an acid component, preferably halogen, particularly chlorine or fluorine, in concentration ranging from about 0.1 to about 3 wt. %, and preferably from about 0.1 to about 3 wt. %. The hydrogenation-dehyrdrogenation components are composited with an inorganic oxide support, such as silica, silica-alumina, magnesia, thoria, zirconia, or the like, and preferably alumina.

Rhenium promoted platinum catalysts are preferred reforming catalysts. In one of its aspects, optimum utilization of rhenium-promoted platinum catalysts is obtained by providing the reactors, subsequent to the first rector of the series, with rhenium in concentration adequate to p;rovide an atomic ratio of rhenium:platinum ranging from about 0.1:1 to about 1:1, preferably from about 0.5:1 to about 1:1. The last reactor of the series may be provided with rhenium in concentration adequate to provide an atomic ratio of rhenium:platinum above about 1.5:1, preferably from about 1.5:1 to about 4:1, and higher, and more preferably from about 2:1 to about 3:1.

The reforming catalyst employed in accordance with this invention is necessarily constituted of composite particles which contain, besides a carrier or support material, a hydrogenation-dehydrogenation component, or components, and a halide component. The support material is constituted of a porous, refractory inorganic oxide, particularly alumina. The support can contain, e.g., one or more of alumina, bentonite, clay, diatomaceous earth, zeolite, silica, activated carbon, mangesia, zirconia, thoria, an the like; though the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30° to 300° A.

The metal hydrogenation-dehydrogenation component can be composited with or otherwise intimately associated with the porous inorganic oxide support or carrier by various techniques known to the art such as ion-exchnge, coprecipitation with the alumina in the sol or gel form, and the like. For example, the catalyst composite can be formed by adding together suitable reagents such as a salt of platinum and ammonium hydroxide or carbonate, and a salt of aluminum such as aluminum chloride or aluminum sulfate to form aluminum hydroxide. The aluminum hydroxide containing the salts of platinum can then be heated, dried, formed into pellets or extruded, and then calcined in nitrogen or other non-agglomerating atmosphere. The metal hydrogenation components can also be added to the catalyst by impregnation, typically via an "incipient wetness" technique which requires a minimum of solution so that the total solution is absorbed, initially or after some evaporation.

It is preferred to deposit the platinum, or platinum and rhenium metals, or other metal or metals used as promoters, if any, on a previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

Platinum in absolute amount, is usually supported on the carrier within the range of from about 0.01 to 3 percent, preferably from about 0.05 to 1 percent, based on the weight of the catalyst (dry basis). Rhenium, in absolute amount, is also usually supported on the carrier in concentration ranging from about 0.1 to about 3 percent, preferably from about 0.5 to about 1 percent, based on the weight of the catalyst (dry basis). The absolute concentration of each for use in reactors is, of course, preselected to provide the desired atomic ratio of rhenium:platinum for a respective reactor of the unit, as heretofore expressed. In the final reactor, or reactors, preferably the rhenium can be provided in major amount relative to the platinum whereas, in contrast, the rhenium is provided in minor amount, or no more than about an equal amount, in the lead reactor, or reactors, relative to the platinum, based on the atomic weight of these metals, one with respect to the other. In compositing the metals with the carrier, essentially any soluble compound can be used, but a soluble compound which can be easily subjected to thermal decomposition and reduction is preferred, for example, inorganic salts such as halide, nitrate, inorganic complex compounds, or organic salts such as the complex salt of acetylacetone, amine salt, and the like. Where, e.g., platinum is to be deposited on the carrier, platinum chloride, platinum nitrate, chloroplatinic acid, ammonium chloroplatinate, potassium chloroplatinate, platinum polyamine, platinum acetylacetonate, and the like, are preferably used. A promotor metal, is added in concentration ranging from about 0.01 to 3 percent, preferably from about 0.05 to about 1 percent, based on the weight of the catalyst.

To enhance catalyst performance in reforming operations, it is also required to add a halogen component to the catalysts, fluorine and chlorine being preferred halogen components. The halogen is contained on the catalyst within the range of 0.1 to 3 percent, preferably within the range of about 1 to about 1.5 percent, based on the weight of the catalyst. When using chlorine as a halogen component, it is added to the catalyst within the range of about 0.2 to 2 percent, preferably within the range of about 1 to 1.5 percent, based on the weight of the catalyst. The introduction of halogen into the catalyst can be carried out by any method at any time. It can be added to the catalyst during catalyst preparation, for example, prior to, following or simultaneously with the incorporation of the metal hydrogenation-dehydrogenation component, or components. It can also be introduced by contacting a carrier material in a vapor phase or liquid phase with a halogen compound such as hydrogven fluoride, hydrogen chloride, ammonium chloride, or the like.

The catalyst is dried by heating at a temperature above about 80° F., preferably between about 150° F. and 300° F., in the presence of nitrogen, oxygen, or both, in an air stream or under vacuum. The catalyst is calcined at a temperature between about 400° F. to 1200° F., preferbly about 500° F. to 1000° F., either in the presence of oxygen, an air stream, or in the presence of an inert gas such as nitrogen.

The feed or charge stock can be a virgin naphtha, cracked naphtha, naphtha from a coal liquefaction process, a shale oil process, a Fischer-Tropsch naphtha, or the like. Such feeds can contain sulfur or nitrogen, or both, at fairly high levels. Typical feeds are those hydrocarbons containing from about 5 to 12 carbon atoms, or more preferably from about 6 to about 9 carbon atoms. Naphthas, or petroleum fractions boiling within the range of from about 80° F. to about 450° F., and preferably from about 125° F. to about 375° F., contain hydrocarbons of carbon numbers within these ranges. Typical fractions thus usually contain from about 15 to about 80 vol. % paraffins, both normal and branched, which fall in the range of about $C_5$+to $C_{12}$, from about 10 to 80 vol. % of naphthenes falling within the range of from about $C_6$ to $C_{12}$.

The reforming runs are initiated by adjusting the sulfur level hydrogen and feed rates, and the temperature and pressure to operating conditions. The reforming run per se is continued at optimum reforming conditions by adjustment of the major process variables, within the ranges described below:

| Major Operating Variables | Typical Process Conditions | Preferred Process Conditions |
|---|---|---|
| Pressure, Psig | 50–750 | 100–400 |
| Reactor Temp., °F. | 800–1200 | 800–1000 |
| Recycle Gas Rate, SCF/B | 1000–10,000 | 1500–400 |

-continued

| Major Operating Variables | Typical Process Conditions | Preferred Process Conditions |
|---|---|---|
| Feed Rate, W/Hr/W | 0.5–10 | 1.0–5 |

Having described the invention, what is claimed is:

1. In a process for reforming, with hydrogen, a naphtha in a cyclic reforming unit which contains a plurality of catalyst-containing on-stream reactors connected in series, and a catalyst-containing swing reactor which, due to an arrangement of process piping and values comprising headers, can be substituted for any one of the on-stream reactors while the latter is off-stream from regeneration and reactivation of the catalyst, the catalyst is a platinum catalyst promoted with a hydrogenation-dehydrogenation component, or components, which increase the rate of hydrogenolysis as contrasted with an unpromoted platinum catalyst, the hydrogen and naphtha feed flows from one reactor of the series to another to contact the catalyst contained therein at reforming conditions, and prior to the introduction of the naphtha into said cyclic reforming unit the naphtha is passed through a hydrofiner and hydrofined to remove a preponderance of the sulfur, and the product thereform then passed through a guard chamber and contacted with a sulfur adsorbent to remove additional sulfur from said naphtha to render it a suitable reformer feed, the improvement comprising maintaining during the major portion of the reforming operating cycle via use of said hydrofiner and guard chamber a reformer feed naphtha sulfur level ranging from about zero to about 2 ppm, and by-passing the hydrofiner and guard chamber with unhydrofined naphtha sufficient to provide a naphtha reformer feed having a sulfur concentration ranging from about 0.6 to about 10 ppm sulfur at the time of, or just prior to the time that a swing reactor containing an unsulfided catalyst is put back on oil, continuing to by-pass the hydrofiner and guard chamber until the catalyst is sufficiently sulfided, discontinuing the flow of by-pass feed, and then again passing the feed through the hydrofiner and guard chamber to the reformer unit.

2. The process of claim 1 wherein the reformer feed naphtha after passage through the hydrofiner and guard chamber has a sulfur level ranging from about 0.01 to about 0.5 ppm.

3. The process of claim 1 wherein the unhydrofined naphtha by-passing the hydrofiner and guard chamber is sufficient to provide a reformer naphtha feed having a sulfur concentration ranging from about 0.6 to about 5 ppm.

* * * * *